US007319210B2

(12) United States Patent
Hosoi et al.

(10) Patent No.: US 7,319,210 B2
(45) Date of Patent: Jan. 15, 2008

(54) IMAGE HEATING APPARATUS

(75) Inventors: Shinichiro Hosoi, Kashiwa (JP); Koki Watanabe, Moriya (JP); Shinichiro Wakahara, Tokyo (JP); Jiro Shirakata, Kashiwa (JP); Koji Takematsu, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/255,026

(22) Filed: Oct. 21, 2005

(65) Prior Publication Data

US 2006/0086725 A1 Apr. 27, 2006

(30) Foreign Application Priority Data

Oct. 22, 2004 (JP) ..... 2004-308687

(51) Int. Cl.
*H05B 6/14* (2006.01)
*H05B 11/00* (2006.01)

(52) U.S. Cl. ..... 219/619; 219/216

(58) Field of Classification Search ..... 219/619, 219/618, 469, 470, 471, 216; 100/300, 301; 399/328, 329, 330, 331
See application file for complete search history.

(56) References Cited

U.S. PATENT DOCUMENTS 5,463,444 A * 10/1995 Watanabe et al. ..... 355/27
6,783,902 B2 * 8/2004 Szajewski et al. ..... 430/21
2004/0206750 A1 10/2004 Sekiguchi et al.
2005/0163529 A1 * 7/2005 Teshigawara ..... 399/107
2005/0220505 A1 * 10/2005 Hashimoto et al. ..... 399/322
2006/0086725 A1 * 4/2006 Hosoi et al. ..... 219/619
2006/0204292 A1 9/2006 Kato et al. ..... 399/328
2007/0071522 A1 * 3/2007 Kaji et al. ..... 399/329

FOREIGN PATENT DOCUMENTS

JP 4-166966 6/1992
JP 5-9027 1/1993
JP 10-74009 3/1998
JP 2004-265670 9/2004
JP 2004-273249 9/2004

* cited by examiner

*Primary Examiner*—Daniel Robinson
(74) *Attorney, Agent, or Firm*—Fitzpatrick, Cella, Harper & Scinto

(57) ABSTRACT

A manufacturing method for an image heating apparatus for heating an image on a recording material by a heat from a heat generating element for producing heat by a magnetic flux generated by magnetic flux generating means, the apparatus including a magnetic flux confining member for confining a magnetic flux directing toward a predetermined region of the heat generating element from the magnetic flux generating means, and a first drive transmission member, provided at one end of the magnetic flux confining member, for transmitting rotational drive to the magnetic flux confining member and a second drive transmission member, provided at the other end of the magnetic flux confining member, for transmitting rotational drive to the magnetic flux confining member, the method comprising an adjusting step of adjusting such that first and second drive transmission members are supported by the magnetic flux confining member with a predetermined rotational position relation, using marks provided on the first and second drive transmission members, respectively.

3 Claims, 14 Drawing Sheets

IMAGE HEATING APPARATUS

FILED OF THE INVENTION AND RELATED ART

The present invention relates to a heating apparatus which heats an image on recording medium with the use of one of the heating methods based on electromagnetic induction. In particular, it relates to a glossiness increasing apparatus for increasing in glossiness an image on recording medium, a fixing apparatus for fixing an image on recording medium, and the like apparatuses.

An image forming apparatus such as a printer, a copying machine, a facsimileing apparatus, etc., employs a fixing apparatus in the form of a heating apparatus, that is, an apparatus for heating an unfixed toner image on recording medium (image which has been transferred onto recording medium), in order to fix the unfixed toner image to the surface of the recording medium. As for the type of a fixing apparatus, there is a fixing apparatus which employs one of the heating methods based on electromagnetic induction, in addition to a fixing apparatus employing a heat roller, and a fixing apparatus employing a heating film.

A fixing apparatus employing one of the heating methods based on electromagnetic induction (which hereinafter may be referred to simply as inductive heating apparatus) employs a heating member in which heat can be generated by electromagnetic induction. As this electromagnetically heatable member is subjected to a magnetic field generated by a magnetic field generating means, eddy current is induced in the electromagnetically heatable member. As a result, heat (Joule heat) is generated in the electromagnetically heatable member by the eddy current. An inductive fixing apparatus applies this heat (Joule heat) to recording medium as an object to be heated, in order to thermally fix the toner image borne on the surface of the recording medium, to the surface of the recording medium.

Japanese Patent Application Publication 5-9027 discloses a fixing apparatus of a heat roller type, in which a fixation roller formed of a ferromagnetic substance is heated by electromagnetic induction, making it possible to place the point of heat generation close to the fixation nip. Thus, this fixing apparatus is more efficient in the fixation process than a fixing apparatus of such a heat roller type that employs a halogen lamp as the heat source.

However, a fixation roller is substantial in thermal capacity. Therefore, a fixing apparatus of the above described type is problematic in that it requires a substantial amount of electric power in order to increase the fixation nip in temperature within a limited amount of time.

Japanese Laid-open Patent Application 4-166966 discloses another fixing apparatus of the electromagnetic induction type, which employs, in place of a fixation roller, a fixation film, that is, a cylindrical member formed of film, which is substantially smaller in thermal capacity than a fixation roller.

However, a fixation film, which is smaller in thermal capacity than an ordinary fixation roller, is inferior to an ordinary fixation roller, in terms of the heat conduction in its width direction (lengthwise direction of fixation nip). Therefore, a fixing apparatus employing a fixation film suffers from the following problem: As recording medium of a small size is conveyed through the fixing apparatus, the portions of the fixation nip, which are outside the recording medium path, excessively increase in temperature (out-of-sheet-path overheating), reducing thereby the fixation film and/or pressure roller in durability. This problem of the out-of-sheet-path overheating also occurs to a fixing apparatus employing an ordinary fixation roller.

Japanese Laid-open Patent Application 10-74009 discloses an inductive heating apparatus characterized in that it is provided with a magnetic flux blocking means for changing in density the magnetic flux distribution in terms of the direction parallel to the lengthwise direction of the fixation roller (width direction of fixation film). This inductive fixing apparatus shows one of the solutions to the problem of the out-of-sheet-path overheating.

Japanese Laid-open Patent Application 10-74009 also discloses a means for adjusting the magnetic flux, across the areas of the magnetic flux which correspond in position to the portions of the fixation roller outside the recording medium path. This magnetic flux adjusting means is made up of a magnetic flux adjusting member disposed between the magnetic flux generating means and fixation roller (film), and a driving means for moving the magnetic flux adjusting member. The magnetic flux generating means driving means comprises: a wire connected to the magnetic flux adjusting member; a pulley around which the wire is stretched; a motor for rotating the pulley; etc.

There has also been devised a means for adjusting the magnetic flux, across the out-of-sheet-path areas, by rotationally moving the magnetic flux blocking member, which is roughly arcuate in cross section, in a manner to follow the peripheral surface of the magnetic flux generating means. In the case of this magnetic flux adjusting means, the magnetic flux is adjusted by changing in dimension the arcuate portions of the magnetic flux blocking member, in terms of the lengthwise direction of the magnetic flux adjusting member.

Further, there has been devised a magnetic flux blocking means employing a magnetic flux blocking member formed of a nonferrous metallic substance. The magnetic flux blocking member of this magnetic flux blocking means is arcuate in cross section, from one lengthwise end to the other. In terms of the circumferential direction of the magnetic flux blocking member, the lengthwise end portions of the magnetic flux blocking member are rendered different in dimension from the lengthwise center portion of the magnetic flux blocking member; the lengthwise end portions are rendered greater in dimension than the center portion. The magnetic flux blocking member is disposed between the holder and magnetic flux blocking member driving means, and the projections extending from the lengthwise ends of the magnetic flux blocking member, one for one, are engaged with the magnetic flux blocking member driving means located at the lengthwise ends of the magnetic flux blocking member, one for one. The portions of magnetic flux blocking member, which are not in engagement with the magnetic flux blocking member driving means, are in contact with the holder. When necessary to adjust the magnetic flux, the magnetic flux blocking member is rotated in contact with the peripheral surface of the holder, into a preset position in which the magnetic flux blocking member partially blocks the magnetic flux.

However, the above described technologies are problematic for the following reasons. That is, according to the above described technologies, the fixing apparatus is not provided with a means for controlling the rotation of the magnetic flux blocking member driving force transmitting means. Therefore, it is difficult to precisely align the pair of magnetic flux blocking member driving force transmitting means when attaching them to the lengthwise end portions of the magnetic flux blocking member, one for one, during the assembly of the fixing apparatus. Therefore, it is possible that the lengthwise ends of the magnetic flux blocking member will not be precisely aligned relative to each other, in terms of the lengthwise direction of magnetic flux blocking member. Thus, it is possible that the magnetic flux blocking member will be mounted in a twisted condition. With the magnetic flux blocking member mounted in the twisted condition, it is reduced in the length of service life by the residual stress resulting from the twisting of the magnetic flux blocking member. Also, the fixing apparatus will malfunction due to the increase in the friction between the holder and magnetic flux blocking member, and the contact between the magnetic flux blocking member and inductively heatable member.

SUMMARY OF THE INVENTION

Thus, the primary object of the present invention is to provide an image heating apparatus, the magnetic flux blocking member of which is not deformed, more specifically, not twisted about its rotational axis, and therefore, does not reduce in the length of service life, nor malfunction, due to the friction between the magnetic flux blocking member and the adjacent components.

According to an aspect of the present invention, there is provided a manufacturing method for an image heating apparatus for heating an image on a recording material by a heat from a heat generating element for producing heat by a magnetic flux generated by magnetic flux generating means, said apparatus including a magnetic flux confining member for confining a magnetic flux directing toward a predetermined region of said heat generating element from said magnetic flux generating means, and a first drive transmission member, provided at one end of said magnetic flux confining member, for transmitting rotational drive to said magnetic flux confining member and a second drive transmission member, provided at the other end of said magnetic flux confining member, for transmitting rotational drive to said magnetic flux confining member, said method comprising an adjusting step of adjusting such that first and second drive transmission members are supported by said magnetic flux confining member with a predetermined rotational position relation, using marks provided on said first and second drive transmission members, respectively.

According to another aspect of the present invention, there is provided an image heating apparatus comprising magnetic flux generating means; a heat generating element for generating heat by a magnetic flux from said magnetic flux generating means, wherein an image on a recording material is heated by heat from said heat generating element; rotatable magnetic flux confining means for confining a magnetic flux directing toward a predetermined region of said heat generating element from said magnetic flux generating means; a first drive transmission member, engaged with one end of said magnetic flux confining means, for transmitting rotational drive; and a second drive transmission member, engaged with the other end of said magnetic flux confining means, for transmitting rotational drive, wherein said first and second drive transmission members are each provided with a mark for being mounted on said magnetic flux confining means with a predetermined relative positional relation between said first and second drive transmission members.

According to a further aspect of the present invention, there is provided an image heating apparatus comprising magnetic flux generating means; a heat generating element for generating heat by a magnetic flux from said magnetic flux generating means, wherein an image on a recording material is heated by heat from said heat generating element; magnetic flux confining means for confining a magnetic flux directing toward a predetermined region of said heat generating element from said magnetic flux generating means; a first drive transmission member, engaged with one end of said magnetic flux confining member, for transmission rotational drive to said magnetic flux confining member; a second drive transmission member, engaged with the other end of said magnetic flux confining member, for transmitting rotational drive; wherein said first and second drive transmission members are fixed on said magnetic flux confining means with a predetermined rotational position relation between said first and second drive transmission members.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

DETAILED DESCRIPTION OF THE PREFERRED EMBODIMENTS (1) Example of Image Forming Apparatus FIG. 1 is a schematic drawing of an example of an image forming apparatus employing the heating apparatus, in accordance with the present invention, employing a heating method based on electromagnetic induction as a thermal image heating apparatus (which hereinafter will be referred to simply as fixing apparatus). This example of an image forming apparatus is a laser printer of the transfer type employing an electrophotographic process.

Figure 1:
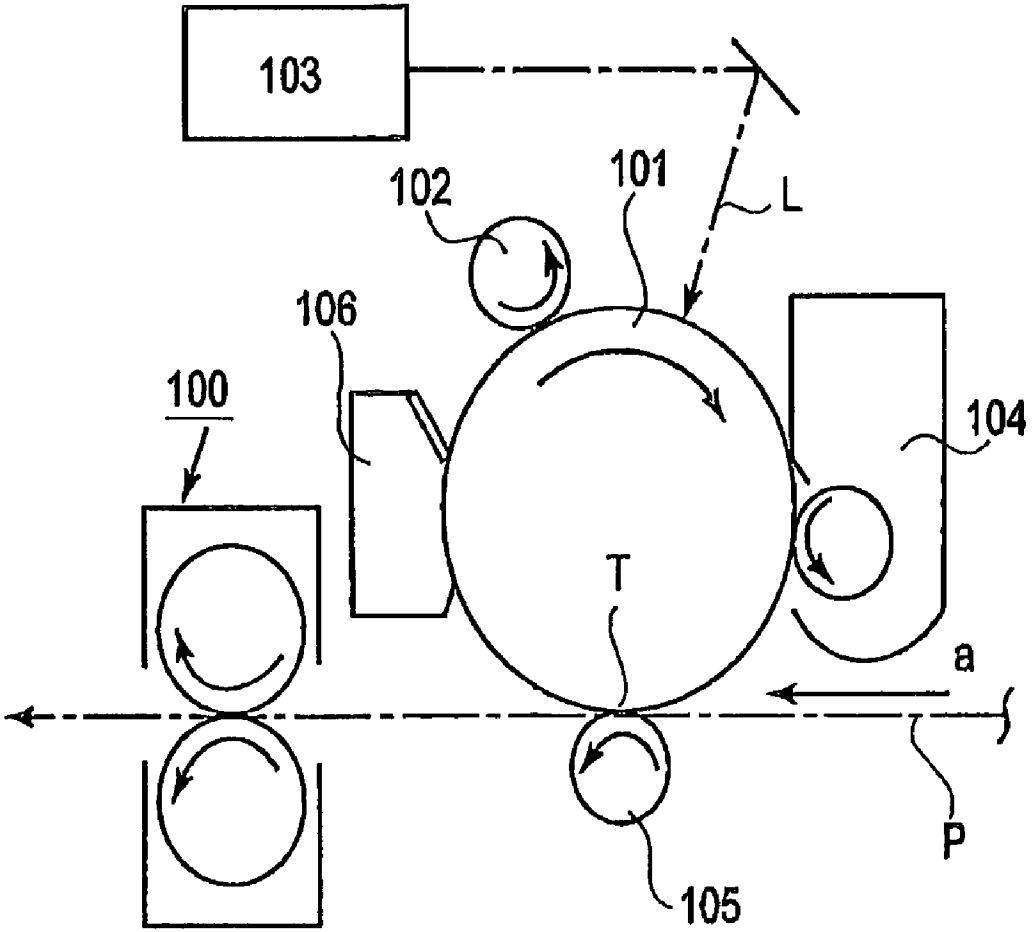
FIG. 1 is a schematic drawing of a typical image forming apparatus, showing the general structure thereof.

Designated by a referential symbol 101 is an electrophotographic photosensitive member in the form of a rotatable drum (which hereinafter will be referred to simply as photosensitive drum). The photosensitive drum 101 is rotationally driven at a preset peripheral velocity in the clockwise direction indicated by an arrow mark.

Designated by a referential symbol 102 is a charge roller, as a charging means, of the contact type, which uniformly charges to predetermined polarity and potential level, the peripheral surface of the photosensitive drum 101 while the photosensitive drum 101 is rotated.

Designated by a referential symbol 103 is a laser scanner as an exposing means. The laser scanner scans, exposing thereby, the uniformly charged peripheral surface of the photosensitive drum 101 by outputting a beam of laser light L, while modulating it with the sequential digital electric video signals which reflect the image formation data. As a result, an electrostatic latent image is formed, which reflects the pattern in which the peripheral surface of the photosensitive drum 101 is scanned (exposed).

Designated by a referential symbol 104 is a developing apparatus, which develops, reversely or normally, the electrostatic latent image on the peripheral surface of the photosensitive drum 101 into an image formed of toner (which hereinafter will be referred to as toner image).

Designated by a referential symbol 105 is a transfer roller as a transferring means, which is kept pressed upon the peripheral surface of the photosensitive drum 101 with the application of a preset amount of pressure, forming a transfer nip T, to which a recording medium P as an object to be heated is conveyed from an unshown recording medium feeding/conveying mechanism with a preset control timing, and then, is conveyed through the transfer nip T while remaining pinched by the photosensitive drum 101 and transfer roller 105. As the recording medium P is conveyed through the transfer nip T, a preset transfer bias is applied to the transfer roller 105 with a preset control timing. As a result, the toner image on the peripheral surface of the photosensitive drum 101 is electrostatically and gradually transferred onto the surface of the recording medium P.

After being conveyed out of the transfer nip T, the recording medium P is separated from the peripheral surface of the photosensitive drum 101, and introduced into the fixing apparatus 100, which fixes the unfixed toner image on the recording medium P by applying heat and pressure to the introduced recording medium P and the unfixed toner image thereon; it turns the unfixed image into a permanent image. After the fixation, the recording medium P is conveyed out of the fixing apparatus.

Designated by a referential symbol 106 is a device for cleaning the photosensitive drum 101, which removes the transfer residual toner, that is, the toner remaining on the peripheral surface of the photosensitive drum 101 after the separation of the recording medium P from the peripheral surface of the photosensitive drum 101. After the cleaning of the peripheral surface of the photosensitive drum 101, that is, the removal of the transfer residual toner, the peripheral surface of the photosensitive drum 101 is used for the following image formation cycle; the peripheral surface of the photosensitive drum 101 is repeatedly used for image formation.

The direction indicated by a referential symbol a is the direction in which the recording medium P is conveyed. As for the positioning of the recording medium P relative to the main assembly of the image forming apparatus, in terms of the direction perpendicular to the recording medium conveyance direction a, the recording medium P is conveyed through the main assembly so that the centerline of the recording medium P is kept aligned with the center of the fixation roller.

(2) Fixing Apparatus 100

Figure 2:
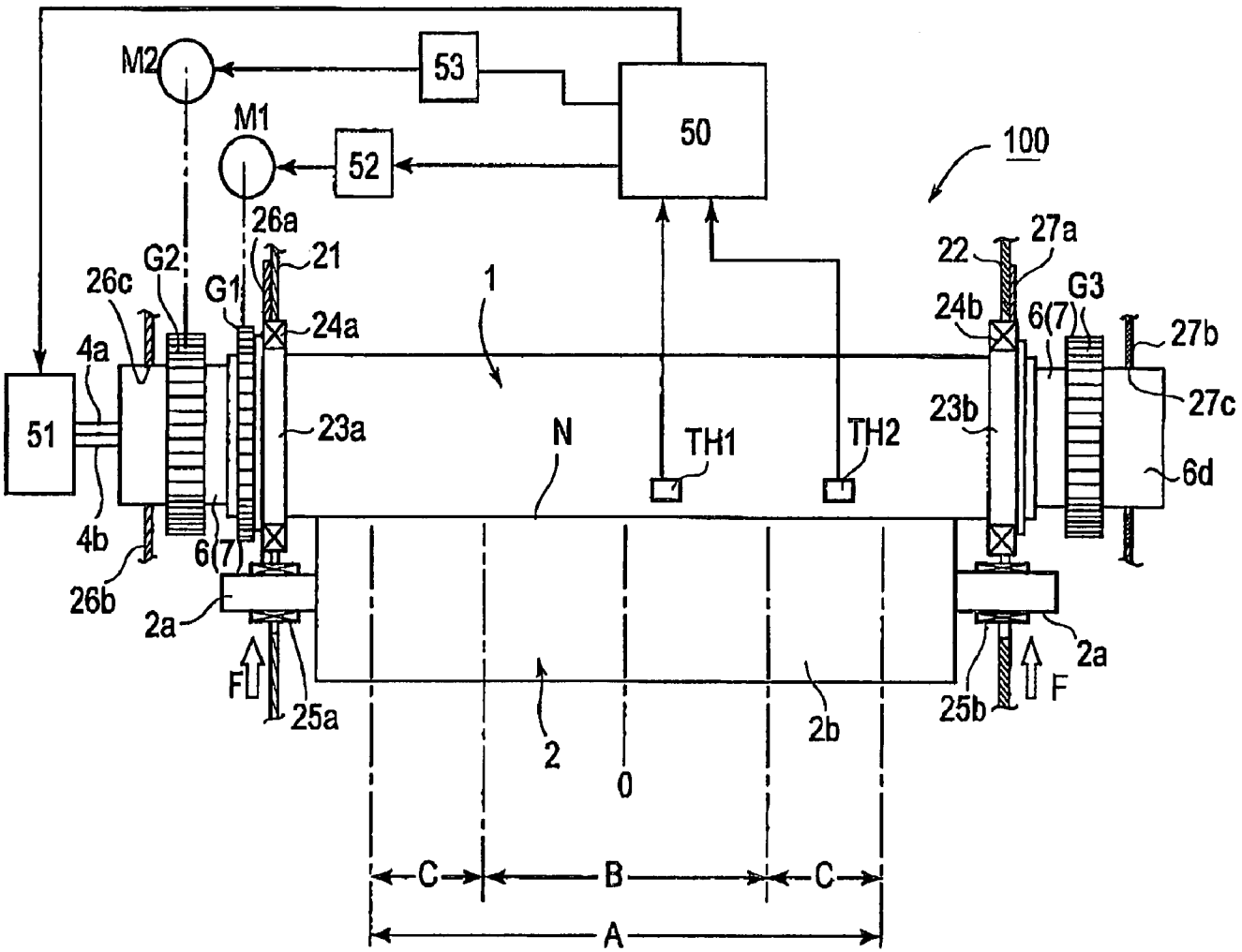
FIG. 2 is a schematic front view of the essential portions of the fixing apparatus.
Figure 3:
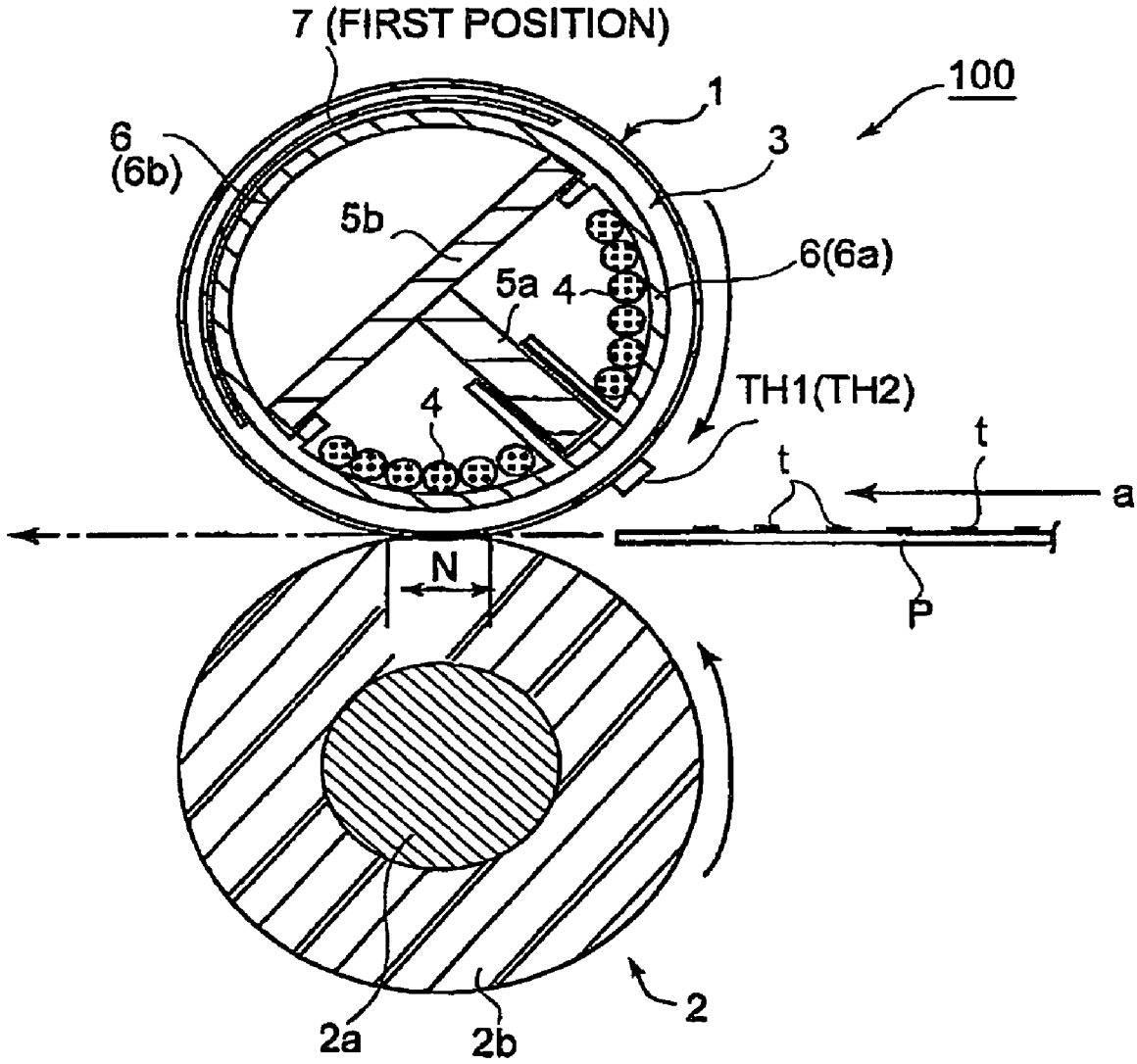
FIG. 3 is an enlarged schematic cross-sectional view of the essential portions of the fixing apparatus.
Figure 4:
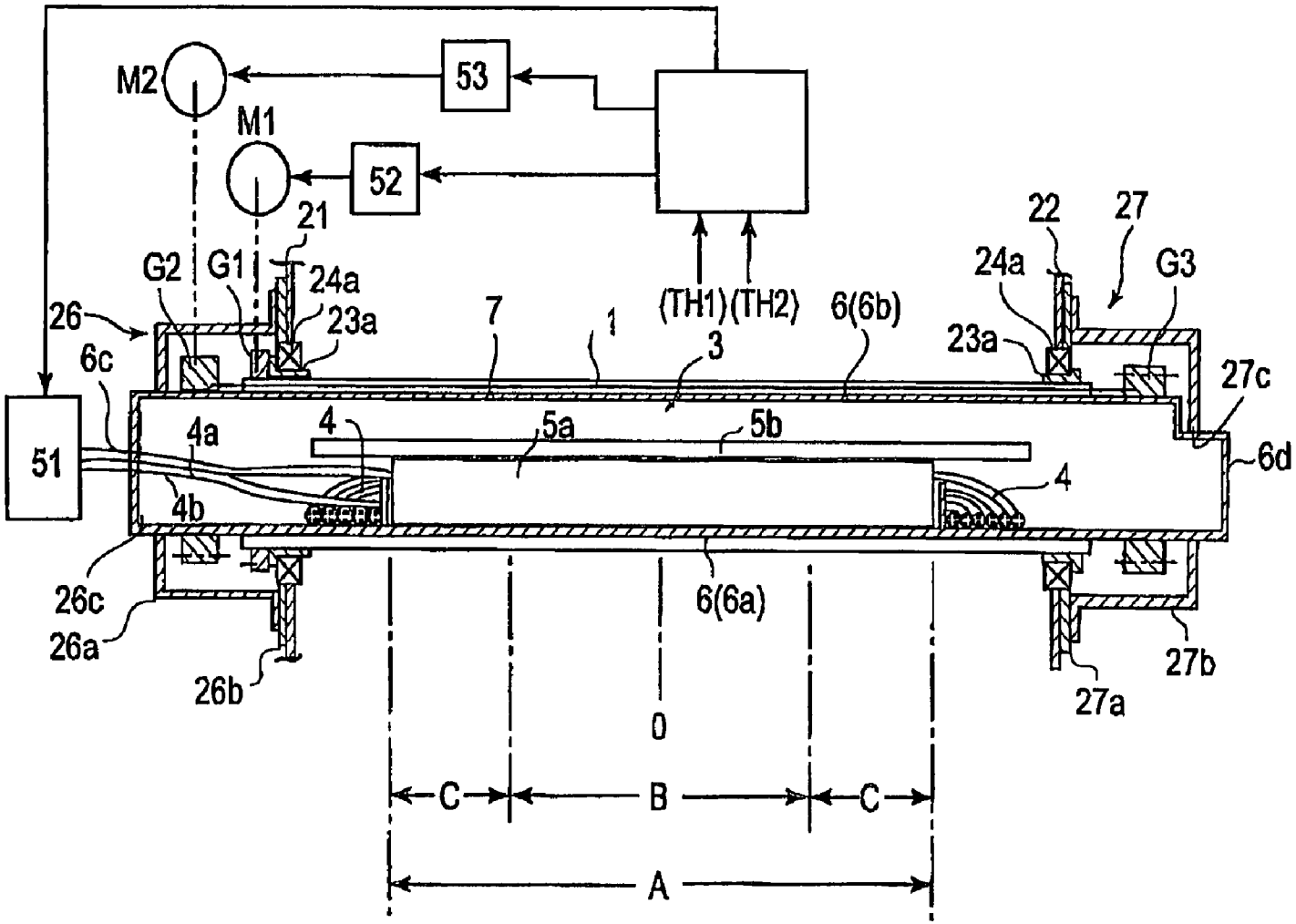
FIG. 4 is a schematic vertical sectional view of the fixation roller assembly portion of the fixing apparatus, at the plane parallel to the axial line of the fixation roller.

FIG. 2 is a schematic front view of the essential portions of the fixing apparatus as an image heating apparatus, and FIG. 3 is an enlarged schematic cross-sectional view of the essential portions of the fixing apparatus. FIG. 4 is a schematic vertical sectional view of the fixation roller assembly portion of the fixing apparatus.

<Fixation Roller>

Designated by a referential symbol 1 is the fixation roller as a member in which heat can be generated by electromagnetic induction. The fixation roller 1 is formed of such a substance as iron, nickel, and SUS 430 (electrically conductive magnetic substance), in which heat can be generated by electromagnetic induction. It is cylindrical, and the thickness of its wall is in the range of 0.1 mm-1.5 mm. Generally, it comprises a toner releasing layer as the surface layer, or the combination of a toner releasing layer, an elastic layer, etc. using one of the ferromagnetic metals (metallic substances with high level of permeability), as the material for the fixation roller, makes it possible to confine a larger portion of the magnetic flux generated by the magnetic flux generating means, in the wall of the fixation roller 1. In other words, it makes it possible to increase the fixation roller in magnetic flux density, making it thereby possible to more efficiently induce eddy current in the surface portion of the metallic fixation roller.

This fixing apparatus 100 is provided with a front plate 21, a rear plate 22, a fixation roller supporting front member 26 (fixation roller axis positioning plate), a fixation roller supporting rear member 27 (fixation roller axis positioning plate). To the fixation roller supporting members 26 and 27, first supporting portions 26*a* and 27*a* are attached, respectively. The fixation roller 1 is provided with a pair of heat insulating bushings 23*a* and 23*b*, which are fitted around the lengthwise end portions of the fixation roller 1. It is rotatably supported at the front and rear lengthwise end portions by the portions 26*a* and 27*a* of the front and rear supporting members 26 and 27, with the interposition of bearings 24*a* and 24*b* disposed between the bushing 23*a* and the portion 26*a* of the front supporting member 26, and between the bushing 23*b* and portion 27*a* of the rear supporting member 27, respectively.

Figure 7:
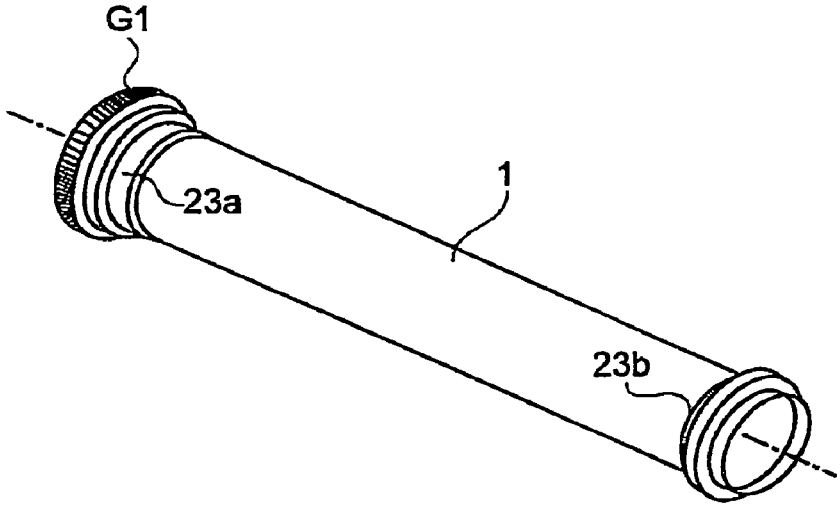
FIG. 7 is an external perspective view of the fixation roller to which the thermally insulative bushings and fixation roller gear have been attached.

The heat insulating bushings 23*a* and 23*b* are employed to minimize the heat transmission from the fixation roller 1 to the bearings 24*a* and 24*b*. Designated by a referential symbol G1 is a fixation roller driving gear fitted fast around the front end portion of the fixation roller 1. As the rotational force from a first motor M1 is transmitted to this gear G1 through a driving force transmission system (unshown), the fixation roller 1 is rotationally driven at a preset peripheral velocity in the clockwise direction indicated by an arrow mark in FIG. 3. FIG. 7 is an external perspective view of the fixation roller 1 fitted with the pair of heat insulating bushings 23*a* and 23*b* and the fixation roller gear G1.

Designated by a referential symbol 2 is a pressure roller as a pressure applying member, which is an elastic roller made up of a metallic core 2*a*, a cylindrical elastic layer 2*b* formed integrally and concentrically around the metallic core 2*a*, etc The elastic layer 2*b* is a layer formed of a rubbery substance, for example, silicone rubber, which displays the releasing property and is heat resistant. This elastic roller 2 is disposed under the fixation roller, in parallel to the fixation roller, being rotatably supported by the front and rear end portions of the metallic core 2*a*, with a pair of bearings 25*a* and 25*b* attached to the front and rear plates 21 and 22, respectively, in such a manner that they can be slid toward the fixation roller 1. Further, the bearings 25*a* and 25*b* are kept pressured upward toward the fixation roller 1 by a pair of pressure applying means (unshown). With the provision of the above described structural arrangement, the pressure roller 2 is pressed against the downwardly facing portion of the peripheral surface of the fixation roller 1, so that a predetermined amount of contact pressure is maintained between the fixation roller 1 and pressure roller 2 against the elasticity of the elastic layer 2*b*. As a result, a fixation nip N, as a heating nip, with a preset width is formed between the fixation roller 1 and pressure roller 2. As the fixation roller 1 is rotationally driven, the pressure roller 2 is rotated by the friction which occurs between the fixation roller 1 and pressure roller 2 in the fixation nip N.

<Coil Assembly>

Figure 8:
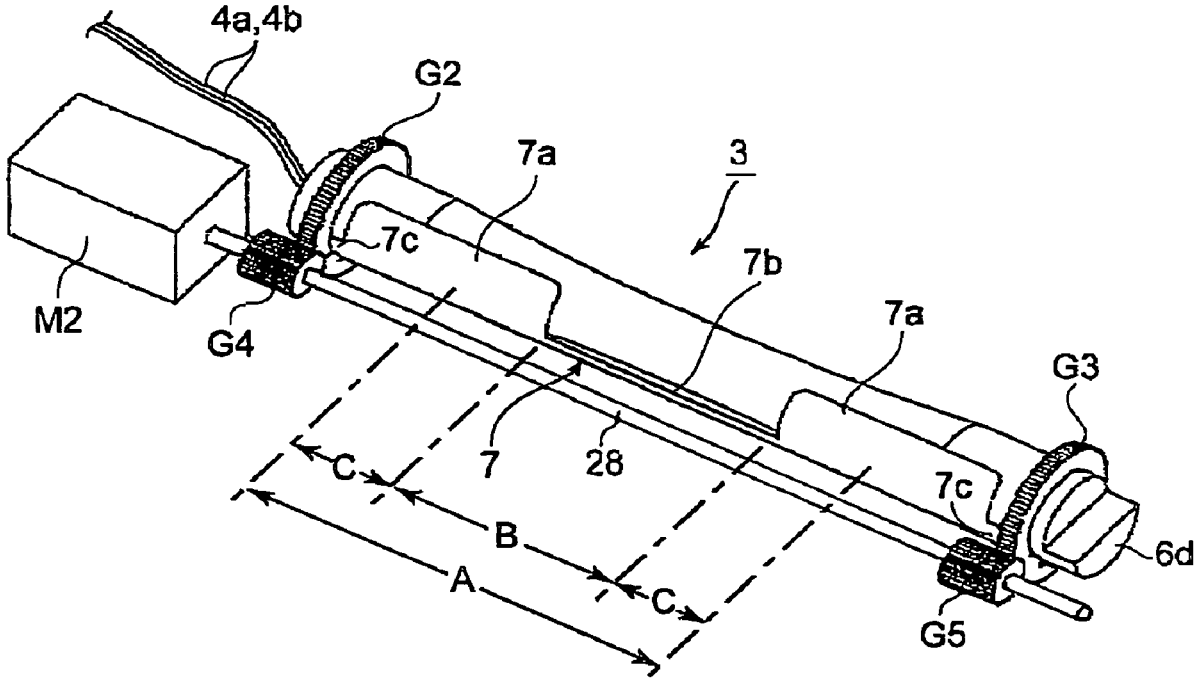
FIG. 8 is an external perspective view of the excitation coil assembly and magnetic flux adjusting member moving means.
Figure 9:
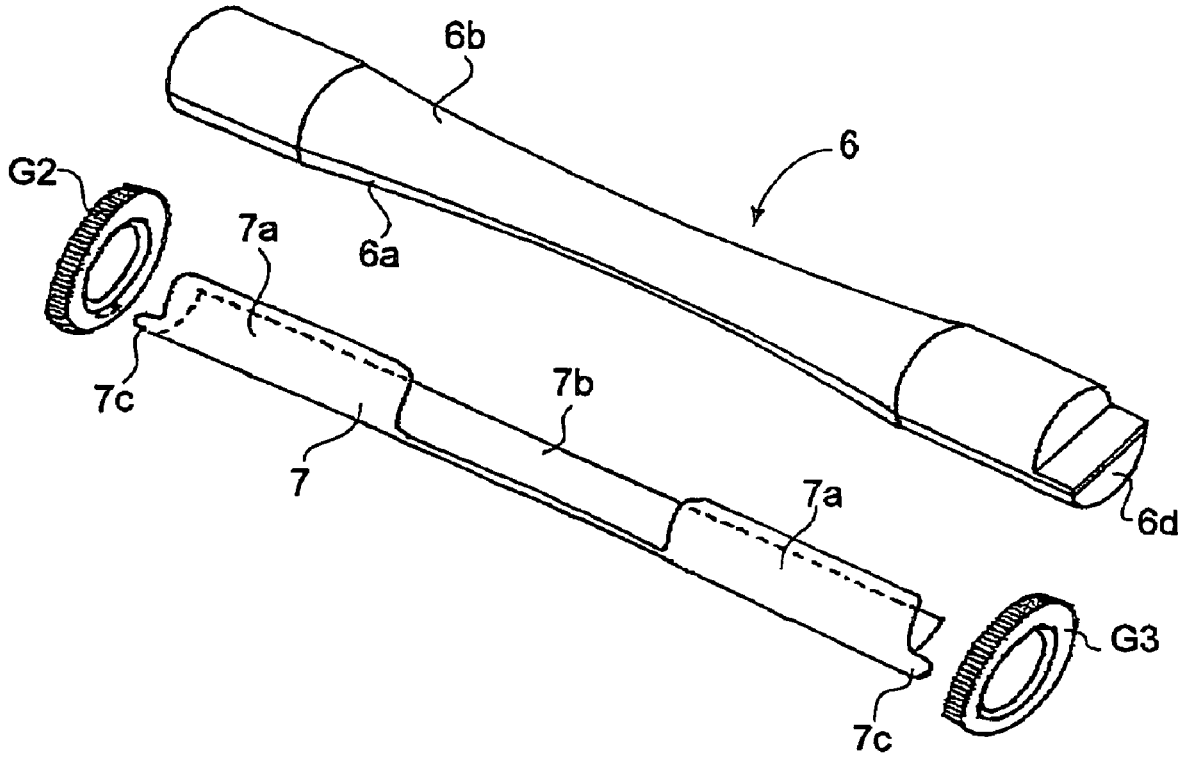
FIG. 9 is an exploded perspective view of the fixation roller assembly, showing the holder and magnetic flux adjusting member.
Figure 10:
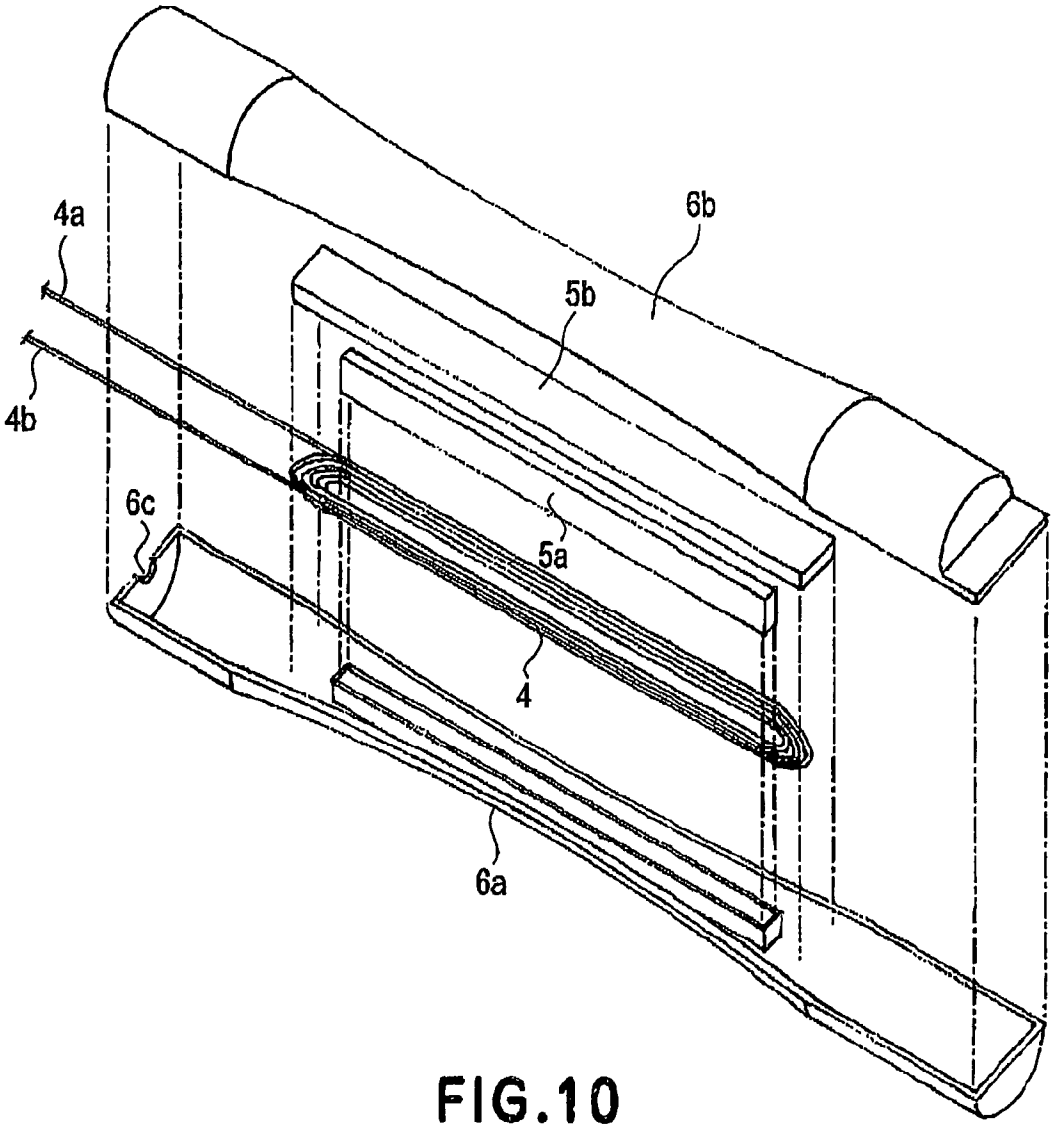
FIG. 10 is an exploded perspective view of the magnetic flux generation assembly, showing the interior of the holder.

Designated by a referential symbol 3 is an excitation coil assembly as a magnetic flux generating means. This excitation coil assembly 3 is disposed (inserted) in the hollow of the above mentioned cylindrical fixation roller 1. The excitation coil assembly 3 is made up of an excitation coil 4 (which hereinafter will be referred to simply as coil), magnetic cores 5*a* and 5*b* (which hereinafter will be referred to simply as cores), and a holder 6. The magnetic cores 5*a* and 5*b* are integrally attached to each other, yielding a component with a T-shaped cross section, and are disposed in the hollow of the holder 6. The excitation coil assembly 3 is also provided with a magnetic flux controlling member 7 (magnetic flux blocking member (magnetic flux reducing member): shutter), which is rotatably disposed on the outward side of the holder 6, coaxially with the holder 6. FIG. 8 is an external view of this excitation coil assembly 3 and means M2, 28, G4, and G5 for moving the magnetic flux controlling member 7. FIG. 9 is an exploded perspective view of the holder 6 and magnetic flux controlling member 7. FIG. 10 is an exploded perspective view of the holder 6, and the components therein.

Hereinafter, the lengthwise direction of the structural components or the portions thereof of the fixing apparatus means the direction perpendicular (intersectional) to the recording medium conveyance direction a.

The holder 6 is roughly cylindrical, being therefore roughly circular in cross section, from one lengthwise end to the other. As the material therefor, a mixture of PPS resin, which is heat resistant and has mechanical strength, and glass fiber, is used. As for the substances, other than the PPS resin, suitable as the material for the holder 6, PEEK resin, polyimide resin, polyamide resin, polyamide-imide resin, ceramic, liquid polymer, fluorinated resin, and the like are available.

Referring to FIG. 10, the holder 6 is made up of two (first and second) roughly semicylindrical portions 6*a* and 6*b*, which are attached to each other with adhesive, or are interlocked to each other by providing the two portions 6*a* and 6*b* with such a shape that makes it possible to interlock the two portions 6*a* and 6*b* with each other, to form the holder 6, which is roughly cylindrical, from one lengthwise end to the other. The coil 4 and cores 5*a* and 5*b* are disposed in the first semicylindrical portion 6*a*, and then, the second semicylindrical portion 6*b* is bonded to the first semicylindrical portion 6*a* in a manner of encasing the coil 4 and core 5*a* and 5*b*, completing the holder 6 which internally holds the coil 4 and core 5*a* and 5*b*. Designated by referential symbols 4*a* and 4*b* are lead wires, which are extended outward from the holder 6 through a hole 6*c* of the front end wall of the holder 6.

Also referring to FIG. 10, the coil 4 has a roughly elliptical shape (shape of long and narrow boat), the major axis of which is parallel to the lengthwise direction of the fixation roller 1. It is disposed in the hollow of the first semicylindrical portion 6*a* of the holder 6 so that its external contour follows the internal surface of the fixation roller 1. The coil 4 must be capable of generating an alternating magnetic flux strong enough to generate a sufficient amount of beat for fixation. Therefore, the coil 4 must be small in electrical resistance, and high in inductance. As the wire for the coil 4, Litz wire is used, which is made by bundling roughly 80-160 strands of fine wire, the diameter of which is in the range of 0.1-0.3 mm. The Litz wire is wound 6-12 times around the first core 5*a*.

The core 5*a* constitutes a first core (equivalent to vertical portion of letter T) around which the Litz wire is wound. The core 5*b* constitutes a second core (equivalent to horizontal portion of letter T). The two cores 5*a* and 5*b* are attached to each other so that the resultant component will be T-shaped in cross section. As the material for the cores 5*a* and 5*b*, such a substance as ferrite that is high in permeability, and yet, is low in residual magnetic flux density, is preferable. However, the only requirement for the material for the cores 5*a* and 5*b* is that the material is capable of generating magnetic flux. In other words, what is required of the material for the cores 5*a* and 5*b* is not particularly restrictive. Further, the cores 5*a* and 5*b* are not required to be in a specific form, or be made of a specific material. Moreover, the first and second core 5*a* and 5*b* may be formed as parts of a monolithic magnetic core, which is T-shaped in cross section.

The fixing apparatus 100 is structured so that the holder 6 of the excitation coil assembly 3 is supported as shown in FIGS. 2 and 4. That is, one of the lengthwise end portions of the cylindrical holder 6 is extended outward beyond the front end of the fixation roller 1, through the front opening of the fixation roller 1, and is fitted in the hole 26*c* of the second portion 26*b* of the front supporting member 26 attached to the outward side of the front plate 21 of the fixing apparatus 100, being thereby supported by the front plate 21. The other lengthwise end portion of the holder 6 is extended outward beyond the rear end of the fixation roller 1, through the rear opening the fixation roller 1, and is fitted in the hole 27*c* of the second portion 27*b* of the rear supporting member 27 attached to the outward side of the rear plate 22 of the fixing apparatus 100, being thereby supported by the rear plate 22. More specifically, the rear end portion of the holder 6 is provided with a D-cut portion 6*d*, and the hole 27*c* of the rear supporting member 27 is D-shaped in cross section. Therefore, the holder 6 is nonrotationally supported by the front and rear plates 26 and 27 of the fixing apparatus 100. Also with the provision of the above described structural arrangement, the holder 6 is disposed in the hollow of the fixation roller 1 so that the two are coaxially disposed while providing a preset amount of gap between the peripheral surface of the holder 6 and internal surface of the fixation roller 1, and also, so that the holder 6 is nonrotationally held in a preset attitude, that is, at a preset angle in terms of its circumferential direction. The aforementioned lead wires 4*a* and 4*b* extending outward from the holder 6 through the hole 6*c*, with which the front end wall of the holder 6 is provided, are connected to an excitation circuit 51. Incidentally, regarding the means for nonrotationally holding the holder 6 at the aforementioned angle (position) in terms of its circumferential direction, in this embodiment, the D-cut end portion 6*d* of the holder 6 is fitted in the hole 27*c* of the portion 27*b* of the second supporting member 27, which is D-shaped in cross section. However, the means for nonrotationally holding the holder 6 at the preset angle (position) does not need to be limited to the above described one. That is, any means will suffice as long as the holder 6 can be nonrotationally held at the preset angle (position) in terms of its circumferential direction.

<Magnetic Flux Controlling Means>

Referring to FIG. 9, the magnetic flux controlling member 7 is shaped so that its cross section is roughly arcuate, from one lengthwise end to the other. It has a pair of shutter portions 7*a* and 7*a* (magnetic flux controlling portions) having the arcuate cross sections and a connective portion 7*b* having also the arcuate cross section. In terms of the lengthwise direction of the magnetic flux controlling member 7, the shutter portions 7*a* and 7*a* are the portions adjacent to the lengthwise ends of the magnetic flux controlling member 7, and the connective portion 7*b* is the center portion of the magnetic flux controlling member 7, which connects the shutter portions 7*a* and 7*a*. In terms of the circumferential direction of the fixation roller 1, the shutter portions 7*a* and 7*a* are wider than the connective portion 7*b*. The connective portion 7*b* is a supporting portion for supporting the arcuate shutter portions 7*a* and 7*a* (magnetic flux controlling portions) attached to, and rotatably supported by, a pair of shutter gears located at the lengthwise ends of the fixation roller assembly (magnetic flux controlling member 7). As for the material for the magnetic flux controlling member 71, such a nonferrous metallic substance as aluminum, copper, or the like is used as the material for the magnetic flux controlling member 7, and among nonferrous metallic substances, those which are lower in electrical resistance are preferable. The magnetic flux controlling member 7 is also provided with a pair of protrusions 7*c* and 7*c*, which protrude from the outward edges of the shutter portions 7*a* and 7*a*, one for one, in the lengthwise direction of the magnetic flux controlling member 7. These protrusions 7*c* and 7*c* are engaged with the first and second shutter gears G2 and G3*c* rotatably fitted around the front and rear end portions of the holder 6 (FIGS. 8 and 9). With the provision of the above described structural arrangement, the magnetic flux controlling member 7 is held at its lengthwise ends by the first and second shutter gears G2 and G3, between the first and second shutter gears G2 and G3. Thus, as the first and second gears G2 and G3 are rotated by the magnetic flux controlling member moving means M2, 28, G4, and G5, the magnetic flux controlling member 7 is rotated within the hollow of the fixation roller 1, more specifically, within the cylindrical gap between the external surface of the holder 6 and the internal surface of the fixation roller 1 in the circumferential direction of the fixation roller 1 (holder 6), with the rotational axis of the magnetic flux controlling member 7 coinciding with that of the holder 6.

Referring to FIG. 8 which depicts the means M2, 28, G4, and G5 for moving the magnetic flux controlling member 7, a referential symbol M2 stands for a second motor; 28: a shaft; G4: first output gear; and a referential symbol G5 stands for a second output gear. The shaft 28, which is located outside the fixation roller 1, is rotatably supported in parallel to the fixation roller 1, by the front and rear plates 21 and 22 of the fixing apparatus 100, with a pair of bearings (unshown) placed between the shaft 28 and the plates 21 and 22. The second motor M2 is a driving force source for rotating the shaft 28, and is a stepping motor. The first and second output gears G4 and G5 are rigidly attached to the shaft 28 so that they are coaxial with the shaft 28. The first and second output gears G4 and G5 are meshed with the first and second shutter gears G2 and G3 of the excitation coil assembly 3, respectively. Thus, as the second motor M2 is rotationally driven, the rotational force is transmitted to the first and second shutter gears G2 and G3, causing thereby the magnetic flux controlling member 7 to rotate about the axial line of the holder 6 in a manner to follow the peripheral surface of the holder 6. As for the material for the gears, one of the various resinous substances may be selected according to the ambient temperature, and the amount of torque to which they are subjected.

Referring to FIG. 2, designated by a referential symbol 50 is a control circuit portion (CPU) as a controlling means, which activates the first motor M1 with a preset control timing, through a driver 52, according to an image formation sequence. As the first motor M1 is activated, the rotational force is given to the driving gear G1 of the fixation roller 1, rotationally driving the fixation roller 1 in the clockwise direction indicated by an arrow mark in FIG. 3, within a preset range. The pressure roller 2 is rotated by the rotation of the fixation roller 1.

The control circuit portion 50 also activates the excitation circuit 51 with a preset timing, supplying thereby the coil 4 with alternating electric current. As a result, an alternating magnetic flux (alternating magnetic field) is generated, and therefore, heat is generated in the wall of the fixation roller 1 by electromagnetic induction, causing the fixation roller 1 to increase in temperature.

Figure 6:
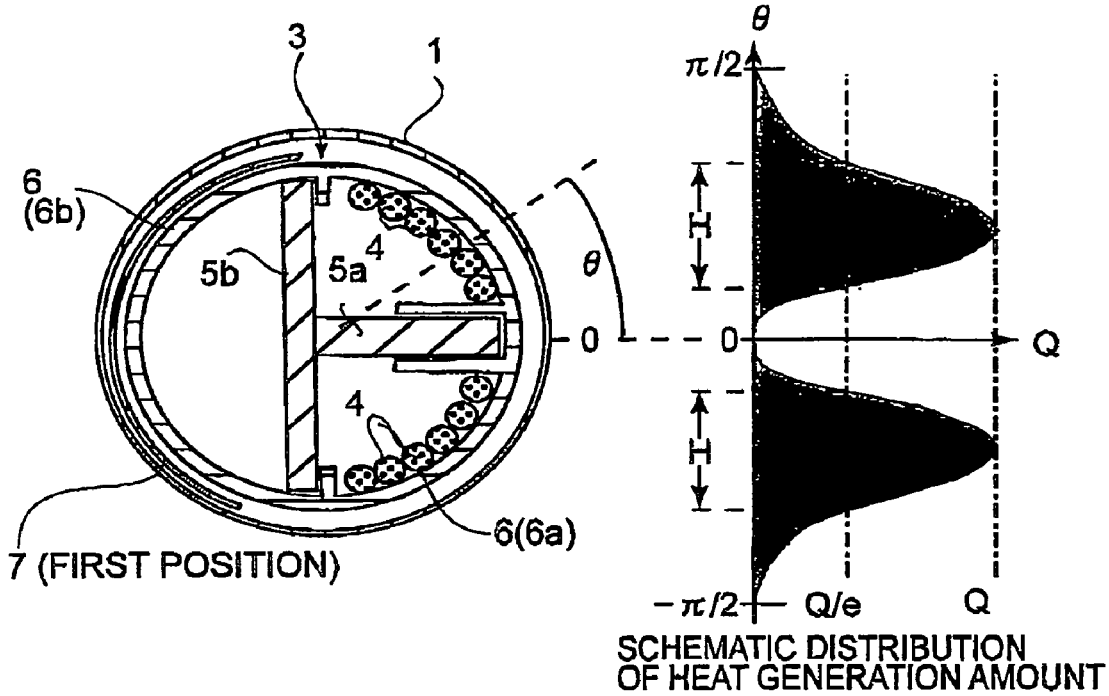
FIG. 6 is a schematic drawing showing the area in which the major portion of the magnetic flux is present, and the distribution of the heat generated in the portion of the fixation roller which corresponds in position to the area.

FIG. 6 is the combination of a schematic cross-sectional view of the fixation roller 1 in the system such as the above described one, and a graph showing the heat distribution of the fixation roller 1 in the heated condition. It shows the areas to which the major portion of the magnetic flux generated by the magnetic flux generating means concentrates, and the corresponding heat distribution of the fixation roller 1, in terms of the circumferential direction of the fixation roller 1. As alternating electric current is flowed through the coil 4, the coil 4 generates an alternating magnetic flux. The fixation roller 1 is formed of a magnetic metal or nonmetallic magnetic substance as described above. Within the wall of the fixation roller 1, eddy current is induced in a manner to neutralize the magnetic field. This eddy current generates heat (Joule heat) in the wall of the fixation roller 1, increasing thereby the fixation roller 1 in temperature.

In the case of the structure of the fixing apparatus in this embodiment, the area in which the major portion of the magnetic flux is generated is on the outward side of the first semicylindrical portion 6*a* of the holder 6, in which the coil 4 and cores 5*a* and 5*b* are disposed. Thus, the portion of the fixation roller 1, which is in this area, is where heat is generated by the magnetic flux. The heat distribution of the fixation roller 1, in terms of the circumferential direction of the fixation roller 1, across the portion in the abovementioned magnetic flux generation area, has two areas H and H, in which most of the heat is generated, as shown by the schematic drawing and graph in FIG. 6. In this embodiment, the holder 6 is nonrotationally held (positioned) at such an angle in terms of the circumferential direction of the holder 6 that the portion of the coil 4, which corresponds to one of the two areas H and H, faces the fixation nip N, and the portion of the coil 4, which corresponds to the other of the two areas H and H, faces the immediate adjacencies of the fixation nip N on the upstream side in terms of the rotational direction of the fixation roller 1.

When the magnetic flux controlling member 7, which is in the gap between the peripheral surface of the holder 6 and the internal surface of the fixation roller 1, is not required to adjust the magnetic flux, it is moved into, and kept in, the position shown in FIGS. 3 and 6, which is on the opposite side of the fixing apparatus from the aforementioned areas in which the major portion of the magnetic flux is generated. This area in which the magnetic flux controlling member 7 is kept when the magnetic flux controlling member 7 is not required to adjust the magnetic flux is where the magnetic flux from the magnetic flux generating means is virtually nonexistent, or extremely low in density. This position shown in FIGS. 3 and 6, in which the magnetic flux controlling member 7 is kept when the magnetic flux controlling member 7 is not required to adjust the magnetic flux, will be referred to as first position.

The temperature of the fixation roller 1 is detected by a central thermistor TH1 as a temperature detecting means, disposed at the roughly mid point of the fixation roller 1 in terms of the lengthwise direction thereof, in contact, or with no contact, with the fixation roller 1, and the detected temperature is inputted into the control circuit 50, which controls the temperature of the fixation roller 1 by controlling the electric power supplied from the excitation circuit 51 to the coil 4, so that the fixation roller temperature detected by the central thermistor TH1 and inputted into the control circuit 50 remains at a preset target temperature (fixation temperature). While the magnetic flux controlling member 7 is kept in the first position shown in FIGS. 3 and 6, the fixation roller 1 is controlled in temperature so that the temperature of the fixation roller 1 is kept at the target level across the entirety of its effective range (heatable range) in terms of its lengthwise direction.

While the fixation roller temperature is kept at the preset fixation level after being raised thereto, a recording medium P bearing an unfixed toner image t is introduced into the fixation nip N, and is conveyed through the fixation nip N while being kept pinched by the fixation roller 1 and pressure roller 2. As the recording medium P is conveyed through the fixation nip N, the unfixed toner image t on the recording medium P is fixed to the surface of the recording medium P by the heat from the fixation roller 1 and the pressure in the fixation nip N.

Hereinafter, the term, recording medium width, means the dimension of a recording medium, in terms of the direction perpendicular to the recording medium conveyance direction a, when the recording medium P is completely flat. As described above, in this embodiment, the recording medium P is conveyed through the fixing apparatus (image forming apparatus) so that the center of the recording medium P in terms of its width direction coincides with the center of the fixing apparatus (fixation roller 1) in terms of the width direction of the recording medium P. Referring to FIGS. 2 and 4, designated by a referential symbol O is the centerline (hypothetical line), as the referential line, of the fixation roller 1 (recording medium) in terms of its lengthwise direction, and designated by a referential symbol A is the path of the largest recording medium, in terms of width, usable with the image forming apparatus. Designated by a referential symbol B is the path of a recording medium which is smaller than the largest recording medium. Hereinafter, a recording medium smaller in width than the largest recording medium will be referred to simply as recording medium of the small size. Designated by a referential symbol C are the areas between the edges of a large recording medium and the edge of a recording medium of the small size. In other words, each of the areas C is the portion of the recording medium passage, which does not come into contact with a recording medium of the small size when the recording medium the small size is conveyed through the fixing apparatus. Since a recording medium is conveyed through the fixing apparatus so that the center of the recording medium in terms of its width direction coincides with the center of the fixation roller 1 in terms of its lengthwise directions there will be two areas C, one on the left side of the path B of a recording medium of the small size, and the other on the right side of the path B of a recording medium of the small size. The width of the areas C is changed by the width of the recording medium being conveyed through the fixing apparatus (image forming apparatus).

The abovementioned central thermistor TH1 used for controlling the temperature of the fixation roller 1 is disposed within the path B of a recording medium of the small size so that it will be within the path of a recording medium regardless of recording medium width.

Designated by a referential symbol TH2 is a peripheral thermistor as a temperature detecting means disposed within one of the areas C, that is, the areas outside the path of a recording medium, in terms of the lengthwise direction of the fixation roller 1, in contact, or with no contact, with the fixation roller 1, in order to monitor the increase in the temperature of the fixation roller 1, across the portions corresponding to the out-of-path areas C. The temperature data obtained by this peripheral thermistor TH2 are also inputted into the control circuit portion 50.

As multiple recording mediums of the small size are consecutively conveyed through the fixing apparatus 100, the portions of the fixation roller 1 corresponding in position to the out-of-path areas C increase in temperature, and this increase in temperature is detected by the peripheral thermistor TH2, and the detected increase in temperature is inputted from the thermistor TH2 to the control circuit portion 50. As the temperature level of the out-of-path area C inputted into the control circuit portion 50 by the peripheral thermistor TH2 exceeds the preset permissible range, the control circuit portion 50 rotates the magnetic flux controlling member 7 from the first position shown in FIGS. 3 and 6 into the second position shown in FIG. 5 by activating the second motor M2 through the driver 53.

The second position for the magnetic flux controlling member 7 is such a position that when the magnetic flux controlling member 7 is in this position, the arcuate shutter portions 7*a* and 7*a*, that is, the virtual end portions of the magnetic flux controlling member 7 in its lengthwise direction, which are wider, in terms of the circumferential direction of the fixation roller 1, than the connective portion 7*b*, that is, the center portion of the magnetic flux controlling member 7, are in the following positions. That is, the arcuate shutter portions 7*a* and 7*a* of the magnetic flux controlling member 7 which is in the gap between the peripheral surface of the holder 6 and the internal surface of the fixation roller 1, are placed in the portions of the above described portions of the gap, one for one, which correspond in position to the out-of-path areas C in terms of the lengthwise direction of the fixation roller 1, and also, to the area in which the major portion of the magnetic flux is generated, in terms of the circumferential direction of the fixation roller 1.

With the magnetic flux controlling member 7 placed in the second position, the magnetic flux from the magnetic flux generating means is reduced in the amount by which it acts on the portion of the fixation roller 1 which corresponds in position to the out-of-path areas C and C. Therefore, the portions of the fixation roller 1 corresponding to the out-of-path areas C are minimized in the amount by which heat is generated therein. Therefore, the problem that the portions of the fixation roller 1 corresponding to the out-of-path areas C increase in temperature is prevented.

Figure 5:
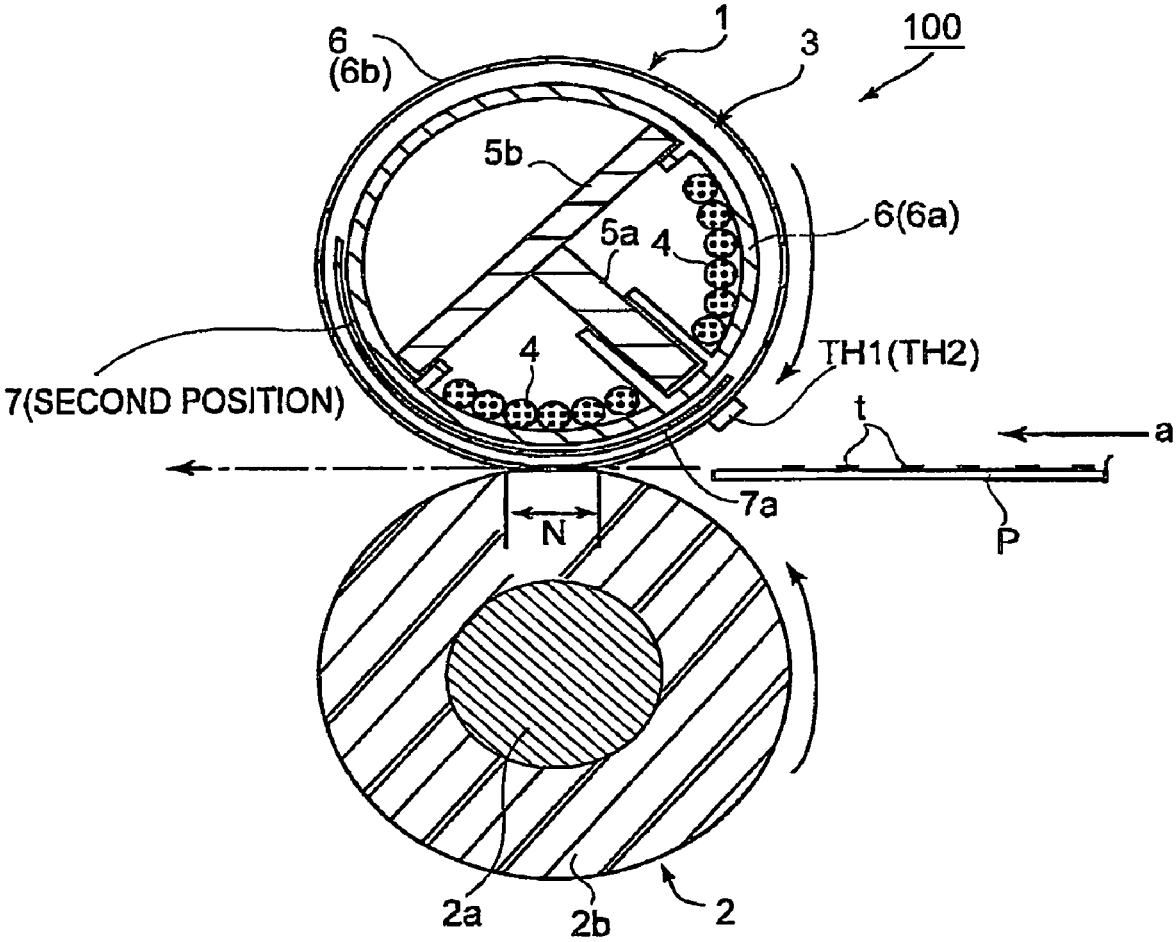
FIG. 5 is an enlarged cross-sectional view of the essential portions of the fixing apparatus, the magnetic flux adjusting member of which is being rotated into the second magnetic flux adjusting position.

It is possible to structure the fixing apparatus 100 so that as the magnetic flux controlling member 7, which is in the gap between the peripheral surface of the holder 6 and the internal surface of the fixation roller 1, is moved into the aforementioned second position, the shutter portions 7*a* and 7*a*, which correspond in position to the out-of-path areas C and C, extend from one end of the magnetic flux generation area, in terms of the circumferential direction of the fixation roller 1 (holder 6), to the other, or a part of the way to the other FIG. 5 shows the structural arrangement in which the shutter portions 7*a* and 7*a* extend from one end of the magnetic flux generation area roughly halfway to the other.

As the magnetic flux controlling member 7 is rotationally moved into the second position, the portions of the fixation roller 1 corresponding to the out-of-path areas C gradually reduce in temperature. As the temperature level of these portions inputted into the control circuit portion 50 by the peripheral thermistor TH2 falls below the predetermined permissible level, the control circuit portion 50 rotationally moves the magnetic flux controlling member 7 into the first position to prevent these portions of the fixation roller 1 from becoming too low in temperature.

Further, if an image forming operation which uses recording mediums of a small size is switched to an image forming operation which uses recording mediums of a large size after the magnetic flux controlling member 7 is moved into the second position during the image forming apparatus using the recording mediums of the small size, the control circuit portion 50 rotates the magnetic flux controlling member 7 back into the first position.

As one of the methods for securing a proper amount of gap between the fixation roller 1 and magnetic flux controlling member 7, there is the method which widens the distance between the magnetic flux controlling member 7 and fixation roller 1. However, this method suffers from the following problem. That is, as the distance between the magnetic flux controlling member 7 and fixation roller 1 is increased, the distance between the core 5 and fixation roller 1 increases, and if the distance between the core 5 and fixation roller 1 is increased beyond a certain value, heat exchange efficiency drastically drops. Therefore, currently, this method is seldom used. The holder 6 is extended, in terms of the circumferential direction of the fixation roller 1, to the opposite side of the fixation roller 1 from where the coil 4 is disposed, making the holder 6 roughly circular in cross section, from one lengthwise end to the other. Shaping the holder 6 as described above makes it possible to make the rotational axes of the holder 6, fixation roller 1, and magnetic flux controlling member 7 coincide, making it therefore possible to improve the fixing apparatus 100 in terms of the accuracy with which these components are positioned relative to each other.

As for the means for transmitting the force for driving the magnetic flux controlling member 7, the front and rear lengthwise end portions of the holder 6 are fitted with the first and second shutter gears G2 and G3, respectively, which are rotatable around the holder 6, as described above. Further, the magnetic flux controlling member 7 is provided with the aforementioned protrusions 7*c*, which protrude outward from the outward edges of the shutter portions 7*a* of the magnetic flux controlling member 7. These protrusions 7*c* are engaged with the first and second shutter gears G2 and G3 so that the magnetic flux controlling member 7 is supported at both of its lengthwise ends, between the gears G2 and G3, by the gears G2 and G3. The shutter gears G2 and G3 are engaged with (fitted around) the holder 6 by the portions which are not engaged with the protrusions 7*c* and 7*c* of the magnetic flux controlling member 7. Therefore, the magnetic flux controlling member 7 can be rotated by the gears G2 and G3, following the peripheral surface of the holder 6. The portion of the holder 6, around which the gear G2 is fitted, and the portion of the holder 6, around which the gear G3 is fitted, are rendered uniform in external diameter across the portions largest in external diameter. Here, the expression that the portions of the holder 6, around which the gears G2 and G3 are fitted, one for one, are largest in external diameter, means that these portions may be provided with ribs so that these portions are rendered uniform in the diameter of the addendum circle of each of these portions inclusive of the ribs. With the employment of this structural arrangement, as the holder 6 and magnetic flux controlling member 7 are engaged with the gears G2 and G3, they are coaxially disposed, making it possible to improve the image heating apparatus in terms of the level of accuracy at which these components are positioned relative to each other.

Basically, the magnetic flux controlling member 7 is arcuate in cross section from one lengthwise end to the other in terms of the lengthwise direction of the fixation roller 1. The lengthwise end portions of the magnetic flux controlling member 7 are different in dimension (in terms of circumferential direction of fixation roller 1: arc length in cross-sectional view) from the center portion of the magnetic flux controlling member 7. When a recording medium of a small size is conveyed through the fixing apparatus, the magnetic flux controlling member 7 is rotated so that the shutter portions 7*a* and 7*a*, that is, the lengthwise portions, of the magnetic flux controlling member 7, are moved into the areas where the magnetic flux is generated, in order to prevent the fixation roller 1 from increasing in temperature across the lengthwise end portions. In this embodiment, the magnetic flux is controlled by moving the shutter portions 7*a* and 7*a*, that is, the magnetic flux blocking portions of the magnetic flux controlling member 7, into the out-of-path areas of the magnetic flux generation area. However, this is not the only method to control a magnetic flux. For example, the following method is possible. That is, the magnetic flux controlling member 7 is shaped so that the center portion of the magnetic flux controlling member 7 constitutes the magnetic flux controlling portion (shutter portion) which corresponds in position to the recording medium passage in terms of the lengthwise direction of the fixing apparatus, and this shutter portion is moved into the magnetic flux generation area to change the magnetic flux in the distribution across the area which corresponds to the recording medium passage. In other words, the temperature of the fixation roller 1 may be adjusted by making the area corresponding to the recording medium path, different from the areas corresponding to the areas outside the recording medium path, in the distribution of the amount by which heat is generated, in terms of the lengthwise direction of the fixation roller 1.

(Method for Aligning Driving Gears)

As described above, the fixing apparatus in this embodiment is provided with the driving gears G2 and G3, as the driving force transmitting members, for transmitting to the magnetic flux blocking member 7 the force for rotationally moving the magnetic flux blocking member 7. The gears G2 and G3 are attached to the lengthwise ends of the magnetic flux blocking member 7, one for one, and the driving gears G2 and G3 are provided with a specific portion with which the magnetic flux blocking member 7 is engaged. Therefore, in order to prevent the magnetic flux blocking member 7 from being twisted when the driving gears G2 and G3 are mounted, it is necessary to precisely align the driving gears G2 and G3 so that as the driving force is transmitted to the driving gears G2 and G3, they move synchronously. In this embodiment, therefore, the fixing apparatus is provided with a means for precisely aligning the driving gears G2 and G3 so that as the driving force is transmitted to the driving gears G2 and G3, they move synchronously.

Figure 11:
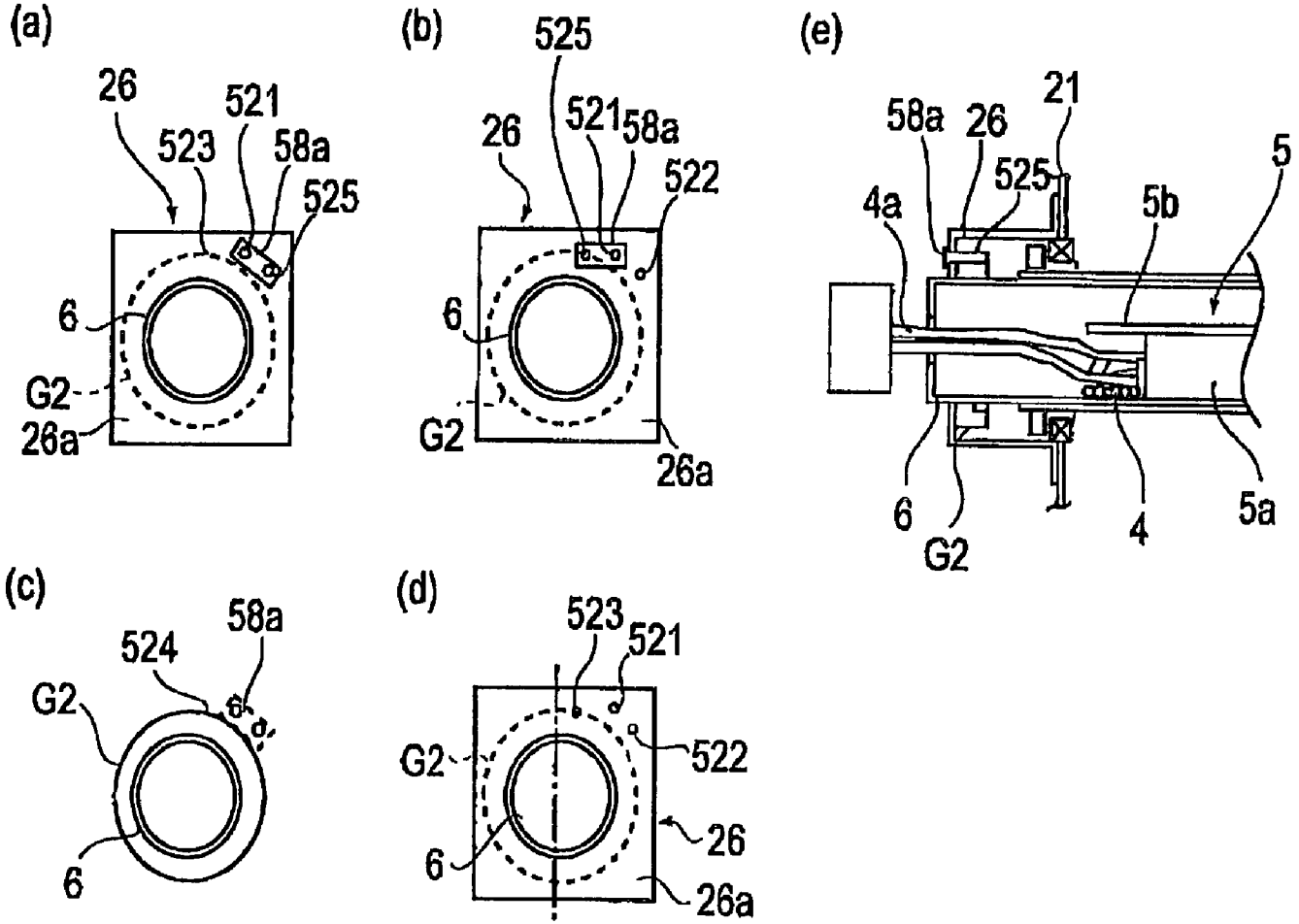
FIG. 11 is a drawing showing the process of positioning the driving gears.
Figure 12:
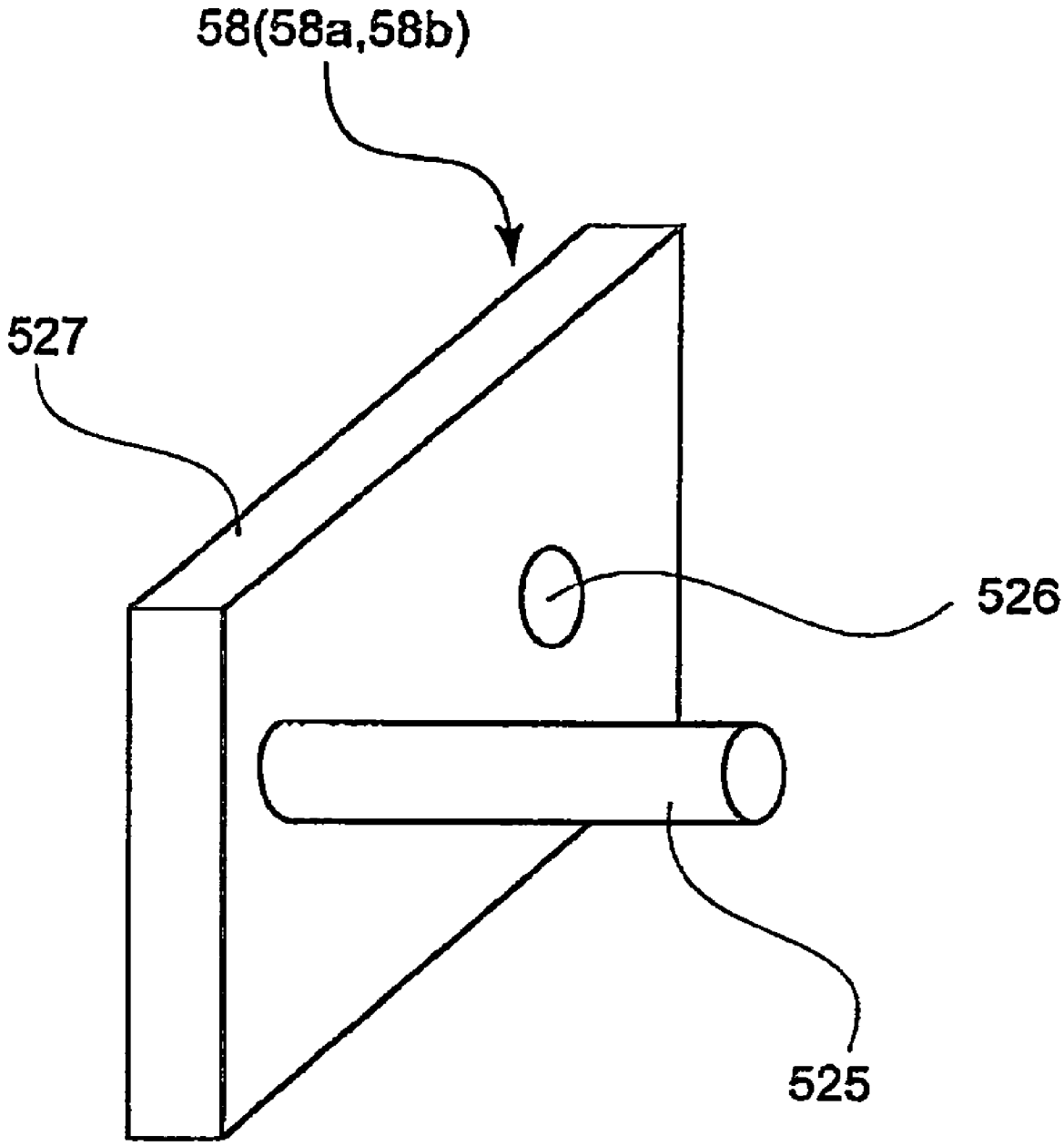
FIG. 12 is a perspective view of the member for aligning the driving gears.

Next, referring to FIGS. 11(*a*), 11(*b*), 11(*c*), and 11(*d*), and FIG. 12, the structural arrangement and method for preventing the magnetic flux blocking member 7 from being twisted about its rotational axis C when the fixing apparatus F is assembled will be described in detail. FIG. 12 is a perspective view of a driving gear aligning member 58 (which hereinafter will be simply referred to as aligning member). FIG. 11(*d*) is a side view of the fixation roller assembly, inclusive of the magnetic flux blocking member 7, shown in FIG. 4, as seen from the left side thereof. FIGS. 11(*a*)-11(*d*) are side views of the portion of the fixation roller assembly shown in FIG. 11(*e*), as seen from the left side thereof. These drawings show, in alphabetical order, the four states of the fixation roller assembly: the state in which the aligning member 58*a* is in the retreat; the state in which the aligning member 58*a* is in the driving gear aligning position; the state in which the holder 26 has been removed; and the state in which the aligning member 58*a* has been removed.

In this embodiment, the aligning member 58 shown in FIG. 12 is employed as the means for precisely aligning the driving gears G2 and G3 for rotationally moving the magnetic flux blocking member 7, when engaging them with the lengthwise ends of the magnetic flux blocking member 7. Also in this embodiment, the driving gears G2 and G3 as the members for transmitting the force for driving the magnetic flux blocking member 7 to the magnetic flux blocking member 7 are provided with the portion with which they are engaged with the magnetic flux blocking member 7. Therefore, the driving gears G2 and G3 can be precisely aligned by aligning the portion of the gear G2, with which the gear G2 is engaged with the magnetic flux blocking member, with the portion of the gear G3, with which the gear G3 is engaged with the magnetic flux blocking member 7. With the gears G2 and G3 precisely aligned, the magnetic flux blocking member 7 is prevented from being twisted. Incidentally, in the following description of the method in this embodiment for precisely aligning the driving gears G2 and G3, the aligning member 58 for aligning the driving gear G2 will be referred to as aligning member 58*a*, whereas the aligning member 58 for aligning the driving gear G2 will be referred to as aligning member 58*b*. Since the two aligning members 58*a* and 58*b* are identical in structure, only the aligning member 58*a* will be described.

Referring to FIG. 12, the aligning member 58*a* is made up of: a base 527 in the form of a piece of flat plate; a positioning pin 525, in the form of a circular column, which perpendicularly projects from one of the primary surfaces of the base 527; and a small screw hole 526 extending from the front surface of the base 527 to the rear surface.

Referring to FIG. 11(*d*), the side wall 26*a* of the holder supporting plate 26 is provided with: a small positioning screw 521, which perpendicularly projects from the side wall 26*a*; a retraction hole 522 (second retaining portion); and a positioning hole 523 (first retaining portion). In terms of the radius direction of the driving gear G2, the small positioning screw 521 and retraction hole 522 are on the outward side of the addendum circle of the driving gear G2, whereas the location of the positioning hole 523 roughly coincides with that of the addendum circle of the driving gear G2. The distance from the small positioning screw 521 to the retraction hole 522, and the distance from the small positioning screw 521 to the positioning hole 523, are equal to the distance from the positioning pin 525 to small screw hole 526 of the aligning member 58*a* shown in FIG. 12. The internal diameter of the retraction hole 522 is the same as that of the positioning hole 523, and is slightly larger than the external diameter of the positioning pin 525 of the aligning member 58*a*. The internal diameter of the small screw hole 526 of the aligning member 58*a* is slightly larger than the small positioning screw 521. The external diameter of the positioning pin 525 of the aligning member 58*a* is rendered virtually the same as the size of the positioning portion (notch) 524 (which hereinafter will be referred to as notch 524) with which a preset portion of the driving gear G2 is provided, so that the positioning pin 525 perfectly fits into the notch 524 of the driving gear G2.

Described next will be the method for precisely aligning the driving gears G2 and G3, that is, the method for precisely aligning the notch of the driving gear G2 with the notch of the driving gear G3, when rigidly attaching the driving gears G2 and G3 to the lengthwise ends of the magnetic flux blocking member 7, one for one, so that as the driving force is transmitted to the driving gears G2 and G3, they rotate synchronously.

The aligning member 58*a* is placed against the holder supporting plate 26 so that: the positioning pin 525 of the aligning member 58*a* shown in FIG. 12 fits into the positioning hole 523 of the side wall 26*a* of the holder supporting plate 26 shown in FIG. 11(*d*), and the tip portion of the positioning pin 525 projects from the rear (inward) side of the side wall 26*a*; and the small positioning screw 521 fits into the small screw hole 526 of the aligning member 58*a* (FIG. 11(*b*)). While holding the aligning member 58*a* against the holder supporting plate 26, the driving gear G2 is to be rotationally slightly moved back and forth to cause the tip portion of the positioning pin 525 to fit into the notch 524 of the gear G2. The fitting of the tip portion of the positioning pin 525 into the notch 524 of the gear G2 precisely positions the driving gear G2 relative to the corresponding lengthwise end of the magnetic flux blocking member 7. The positioning pin 525 is a means for regulating the rotation of the driving gear G2.

The assembly steps similar to those described above are to be carried out for the gear G3 with the use of the aligning member 58*b*. Not only does the completion of these steps result in the precise positioning of the driving gear G3 (notch 524 of driving gear G3) when attaching to the other lengthwise ends of the magnetic flux blocking member 7, but also, the precise positioning of the portion (notch 524) with which the preset portion of the driving gear G3 is provided to engage the gear G3 with the other lengthwise end of the magnetic flux blocking member 7. The completion of the above described steps results in the precise alignment of (accurate positioning of) the driving gears G2 and G3. In other words, the driving gears G2 and G3 are precisely aligned relative to each other so that they are forced to rotate synchronously. In this embodiment, the positioning hole 523 and notch 524 are positioned so that the usage of the driving gear aligning members 58 as the means for aligning the driving-gears G2 and G3 relative to each other when attaching them to the lengthwise ends of the magnetic flux blocking member 7, one for one, prevents the magnetic flux blocking member from being twisted when it is rotationally moved.

After the completion of the above described assembly steps, the driving means (M2, G4, and G5) for driving the driving gears G2 and G3 are engaged with the driving gears G2 and G3. Consequently, the driving gears G2 and G3 are positioned relative to the magnetic flux blocking member 7 so that as they are rotationally driven by the driving gear driving means, the preset rotational relationships are maintained between the driving gears G2 and G3 and the magnetic flux blocking member 7. Next, the aligning member 58*a* is separated from the side wall 26*a* of the holder supporting plate 26: its positioning pin 525 is pulled out of the positioning hole 523; the small positioning screw 521 is pulled out of the small screw hole 526; and the small positioning screw 521 is fitted into the small screw hole 526 while inserting the positioning pin 525 into the retraction hole 522. Therefore, it does not occur that the aligning member 58*a* interferes with the rotation of the driving gears G2 and magnetic flux blocking member 7. This is also true with the other aligning member 58*b*.

In this embodiment, each of the driving gears is rigidly attached with the use of the positioning pin 525. Therefore, not only do the driving gears rotate synchronously with each other, but also, the two driving gears are prevented from becoming misaligned from each other when the driving means (M2, G4, and G5) for driving the driving gears are mounted.

In this embodiment, the magnetic flux blocking member 7 can be rotationally moved, with the difference in phase between the end portions of the magnetic flux blocking member 7, in terms of the direction parallel to the rotational axis of the magnetic flux blocking member 7, remaining the same, by synchronously driving the driving gears G2 and G3 rigidly attached to the lengthwise end portions of the magnetic flux blocking member 7, one for one. In addition, even after the driving gears G2 and G3 are aligned so that the two gears rotate synchronously, the driving gear aligning members 58*a* and 58*b* can be retained in the fixing apparatus, making it easier to attach or remove the magnetic flux blocking member 7 after the aligning of the two gears.

Also in this embodiment, the aligning of the driving gear G2 (G3) is accomplished by aligning the positioning hole 523 (first retaining portion) of the holder supporting plate with the positioning notch 524 of the driving gear G2 (G3).

Incidentally, the rotation of each driving gear is regulated by putting the positioning pin 525 of the driving gear aligning member through the positioning hole. However, instead of regulating the rotation of the driving gears with the use of the positioning pin, the driving gears may be aligned relative to each other by aligning the positioning holes. Further, instead of the positioning holes, positioning markings may be provided so that the driving gears can be precisely aligned relative to each other by aligning the positioning markings.

With the provision of the above described structural arrangement, it does not occur that the end surface of the first core 5*a*, in terms of the radius direction of the holder 6, around which the magnetic flux concentrates, is entirely covered with the magnetic flux controlling member in terms of the lengthwise direction of the first core 5*a*. Therefore, it does not occur that the magnetic flux controlling member 7 and/or coil 4 abnormally increases in temperature. Further, it does not occur that the electric power source is damaged by the sudden decrease in the impedance L of the coil 4.

Incidentally, in this embodiment, the rotation regulating members are located at both lengthwise ends of the magnetic flux controlling member. However, this embodiment is not intended to limit the scope of the present invention. For example, the regulating member(s) may be located at only one of the lengthwise ends, or the center, of the magnetic flux controlling member. When placing the regulating member at only one of the lengthwise ends of the magnetic flux controlling member, the lengthwise end of the magnetic flux controlling member at which the regulating member is placed is desired to be the same lengthwise end as where the driving force generating means (driving power source) for moving the magnetic flux controlling member is disposed. With the employment of this structural arrangement, it is possible to minimize the amount by which the magnetic flux controlling member is twisted when its movement is regulated by the regulating member.

(3) Miscellanies

Figure 13:
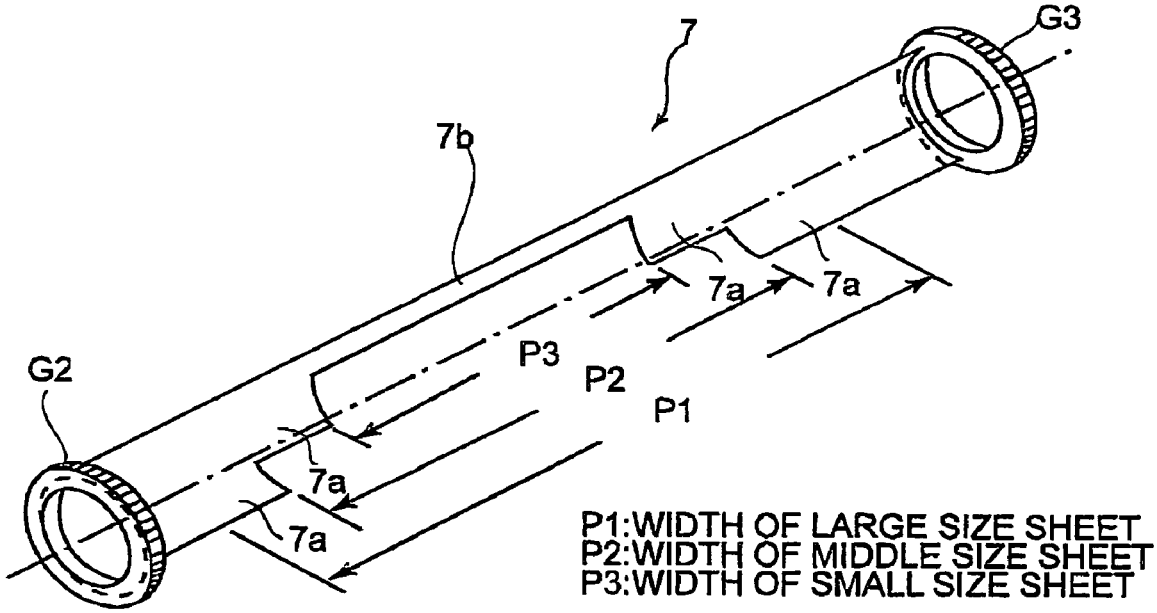
FIG. 13 is a schematic perspective view of the magnetic flux adjusting member given a shape that enables it to deal with three recording medium sheet sizes: large, medium, and small sizes.

1) The apparatus in this embodiment was provided with the first and second magnetic flux controlling positions into which the magnetic flux controlling member 7 can be moved into, and which corresponds to the large or small size of recording medium. However, this embodiment is not intended to limit the scope of the present invention. Obviously, the apparatus may be provided with three or more magnetic flux controlling positions into which the magnetic flux controlling member 7 can be moved, and which correspond to three or more recording medium widths, respectively. FIG. 13 is a schematic perspective view of the magnetic flux controlling member 7 enabled to deal with three recording medium sheet sizes: large, medium, and small.

Figure 14:
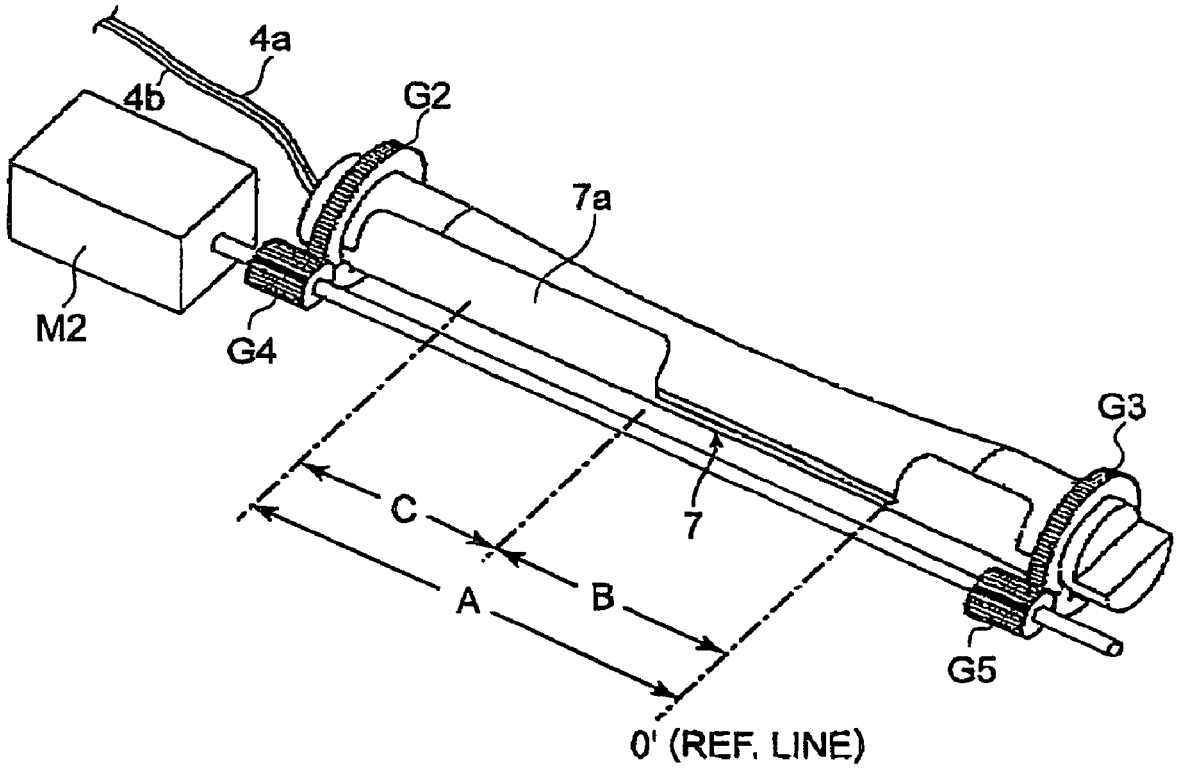
FIG. 14 is a schematic perspective view of the magnetic flux adjusting member driving mechanism for an image forming apparatus structured so that when a sheet of recording medium is conveyed through it, one of the lateral edges of the sheet of recording medium is kept aligned with the recording medium conveyance referential line of the apparatus.
Figure 15:
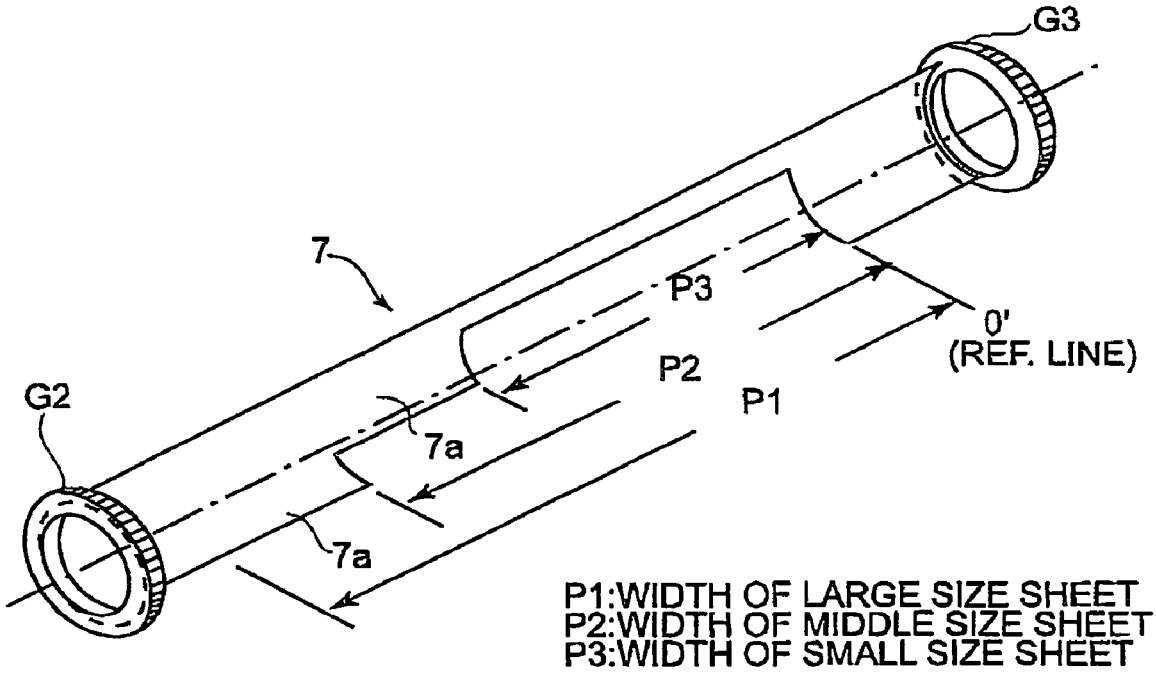
FIG. 15 is a schematic perspective view of another magnetic flux adjusting member driving mechanism for an image forming apparatus structured so that when a sheet of recording medium is conveyed through it, one of the lateral edges of the sheet of recording medium is kept aligned with the recording medium conveyance referential line of the apparatus.

2) The apparatus in this embodiment is structured so that when a sheet of recording medium is conveyed through the apparatus, the center of the recording medium in terms of the direction perpendicular to the recording medium conveyance direction coincides with the lengthwise center of the heating member (fixation roller). However, the present invention is also effectively applicable to an apparatus structured so that when a sheet of recording medium is conveyed through the apparatus, one of the lateral edges of the sheet of recording medium is kept aligned with the recording medium conveyance referential line (edge, rib, or the like) with which the apparatus is provided. FIGS. 14 and 15 show the magnetic flux controlling member driving mechanism and the magnetic flux controlling member, respectively, in an apparatus in which one of the lateral edges of a sheet of recording medium is aligned with the recording medium conveyance referential line (edge, rib, or the like) with which the apparatus is provided. The line designated by a referential symbol O' in FIG. 14 is the referential line.

3) The usage of an inductive image heating apparatus in accordance with the present invention is not limited to the usage as the image heating apparatus in this embodiment. That is, an inductive image heating apparatus in accordance with the present invention is also effectively usable as such an image heating apparatus as a fixing apparatus for temporarily fixing an unfixed image to recording medium, or a surface property changing apparatus for reheating a sheet of recording medium bearing a fixed image, along with the fixed image, to change the sheet of recording medium and the fixed image thereon in surface properties such as glossiness. Moreover, it is effectively usable as such an image heating apparatus for heating an object in the form of a sheet, as a thermal pressing apparatus for removing the wrinkles from an object in the form of a sheet, or a thermal drying apparatus for evaporating the water content from an object containing water, which is obvious.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 308687/2004 filed Oct. 22, 2004 which is hereby incorporated by reference.

What is claimed is:

1. An image heating apparatus comprising:

magnetic flux generating means;

a heat generating element for generating heat by a magnetic flux from said magnetic flux generating means, wherein an image on a recording material is heated by heat from said heat generating element;

rotatable magnetic flux confining means for confining a magnetic flux directing toward a predetermined region of said heat generating element from said magnetic flux generating means;

a first drive transmission member, engaged with one end of said magnetic flux confining means, for transmitting rotational drive; and a second drive transmission member, engaged with the other end of said magnetic flux confining means, for transmitting rotational drive, wherein said first and second drive transmission members are each provided with a mark for being mounted on said magnetic flux confining means with a predetermined relative positional relation between said first and second drive transmission members.

2. An apparatus according to claim 1, wherein the marks include a first mark, and said apparatus further comprises a second mark provided at a predetermined position corresponding to the first mark, and wherein the marks further include a third mark, and said apparatus further comprises a fourth mark provided at a predetermined position corresponding to the third mark.

3. An apparatus according to claim 1, further comprising driving applying means, engaged with said first and second drive transmission members, for applying rotational drive to said first and second drive transmission members while maintaining a predetermined rotational position relation between said first and second drive transmission members.

* * * * *

UNITED STATES PATENT AND TRADEMARK OFFICE

CERTIFICATE OF CORRECTION

PATENT NO. : 7,319,210 B2
APPLICATION NO. : 11/255026
DATED : January 15, 2008
INVENTOR(S) : Shinichiro Hosoi et al.

It is certified that error appears in the above-identified patent and that said Letters Patent is hereby corrected as shown below:

On the Title Page, Item (57)
IN THE ABSTRACT
Line 2, “a” (second occurrence) should be deleted.

COLUMN 1
Line 3, “FILED” should read --FIELD--.

COLUMN 18
Line 39, “moved” should read --moved,--.
Line 40, “into,” should be deleted.
Line 40, “corresponds” should read --correspond--.

Signed and Sealed this

Seventeenth Day of February, 2009

JOHN DOLL
*Acting Director of the United States Patent and Trademark Office*